US010550556B2

(12) United States Patent
Bush

(10) Patent No.: US 10,550,556 B2
(45) Date of Patent: Feb. 4, 2020

(54) POWER SUPPLY ASSEMBLY FOR PLUMBING FIXTURE

(71) Applicant: I-CON SYSTEMS, INC., Oviedo, FL (US)

(72) Inventor: Shawn D. Bush, Winter Park, FL (US)

(73) Assignee: I-CON Systems, Inc., Oviedo, FL (US)

( * ) Notice: Subject to any disclaimer, the term of this patent is extended or adjusted under 35 U.S.C. 154(b) by 0 days.

(21) Appl. No.: 16/028,087

(22) Filed: Jul. 5, 2018

(65) Prior Publication Data

US 2019/0010683 A1 Jan. 10, 2019

Related U.S. Application Data

(60) Provisional application No. 62/529,141, filed on Jul. 6, 2017.

(51) Int. Cl.

| | |
|---|---|
| ***E03C 1/05*** | (2006.01) |
| ***E03D 5/10*** | (2006.01) |
| ***E03C 1/04*** | (2006.01) |

(52) U.S. Cl.

CPC ..... *E03C 1/057* (2013.01); *E03C 1/0404* (2013.01); *E03D 5/105* (2013.01)

(58) Field of Classification Search

CPC ..... E03C 1/057
USPC ..... 4/623
See application file for complete search history.

(56) References Cited

U.S. PATENT DOCUMENTS

| | | | |
|---|---|---|---|
| 2003/0201018 | A1 | 10/2003 | Bush |
| 2006/0010591 | A1 | 1/2006 | Bush |
| 2008/0245422 | A1 | 10/2008 | McTargett |
| 2016/0017585 | A1 | 1/2016 | Plate et al. |
| 2016/0097189 | A1 | 4/2016 | Guidish |

*Primary Examiner* — Lori L Baker
(74) *Attorney, Agent, or Firm* — The Webb Law Firm

(57) ABSTRACT

A power supply assembly and method for a plumbing fixture includes a control circuit that controls operation of the plumbing fixture, and a wireless power receiving circuit coupled to the control circuit that wirelessly receives energy and provides the energy to the control circuit.

23 Claims, 6 Drawing Sheets

POWER SUPPLY ASSEMBLY FOR PLUMBING FIXTURE

CROSS REFERENCE TO RELATED APPLICATIONS

This application claims the benefit of U.S. Provisional Application No. 62/529,141, entitled "Power Supply Assembly for Plumbing Fixture" and filed Jul. 6, 2017, the disclosure of which is hereby incorporated by reference in its entirety.

BACKGROUND OF THE INVENTION

1. Field of the Invention

This invention relates generally to plumbing fixtures, such as toilet fixtures, shower fixtures, faucet fixtures, and drinking fountain fixtures, and, in one particular embodiment, to a system, method, and apparatus for supplying power to a plumbing fixture.

2. Technical Considerations

Electronically controlled plumbing fixtures are now well-known and widely used in commercial and industrial settings. Typically, an electronically controlled plumbing fixture may include an automatic flushing system that will cause the automatic flushing of a toilet or urinal after a user leaves the immediate proximity of the toilet or urinal. The automatic flushing systems known in the art use a beam of radiation, such as infrared radiation, directed to an area in front of the toilet or urinal. The radiation beam is interrupted and reflected by the user of the toilet or urinal. The interruption and/or reflection of the radiation beam is transmitted as an input signal to a control circuit or device of some type. The control circuit or device then initiates a flush signal to a flush mechanism or device, such as a solenoid, which actuates the flush valve and flushes the toilet or urinal. In other flushing systems known in the art, the user of the toilet or urinal may actuate a button on the toilet or urinal to initiate the flush signal to the flush mechanism or device. These types of devices are now commonly found in hotels, airports, sport stadiums, and other similar public facilities.

These electronically controlled plumbing fixtures require a power supply assembly to operate the control circuits and sensors, and to drive the flush mechanisms. Typically, a hardwired connection to a mains power supply is made through a wall adjacent to the plumbing fixture in order to provide a power supply for the components requiring electrical power. These types of hardwired assemblies result in more difficult and less streamlined installations of plumbing fixtures and higher installation costs, for example, due to construction and alignment requirements associated with through wall electrical connections. Other known electronically controlled flushing systems and plumbing fixtures may use a battery as a power supply to avoid the requirement of a hardwired power supply; however, the battery in these assemblies must be regularly removed and replaced as its charge is depleted.

Therefore, it would be advantageous to provide a power supply assembly and method that reduces or eliminates at least some of the problems associated with known power supply assemblies and methods for plumbing fixtures.

SUMMARY OF THE INVENTION

Generally, provided are an improved power supply assembly and method for a plumbing fixture, preferably for use in connection with an electronically controlled plumbing fixture, such as, a toilet or urinal. Preferably, provided are a power supply assembly and method that result in a cleaner looking and easier installation of a plumbing fixture. Preferably, provided are a power supply assembly and method that do not require a through wall hardwired connection to a mains electrical power supply. Preferably, provided are a power supply assembly and method that do not require direct contact with a power supply to receive a supply of power. Preferably, provided are a power supply assembly and method that enable a battery of an electronically controlled plumbing fixture to be replaced without requiring a disassembly of a flush valve of the plumbing fixture.

According to one preferred and non-limiting embodiment or aspect, provided is a power supply assembly for a plumbing fixture, comprising: a control circuit configured to control operation of the plumbing fixture; and a wireless power receiving circuit coupled to the control circuit, the wireless power receiving circuit configured to wirelessly receive energy and provide the energy to the control circuit.

In one preferred and non-limiting embodiment or aspect, the power supply assembly further comprises a housing configured for mounting on the plumbing fixture, the housing including the wireless power receiving circuit coupled to the control circuit.

In one preferred and non-limiting embodiment or aspect, the control circuit is configured to drive a solenoid to control the operation of the plumbing fixture.

In one preferred and non-limiting embodiment or aspect, the wireless power receiving circuit includes a battery configured to store the energy, wherein the wireless power receiving circuit is configured to charge the battery with the energy, and wherein the control circuit is configured to receive a supply of power from the battery.

In one preferred and non-limiting embodiment or aspect, the wireless power receiving circuit is configured to receive the energy wirelessly from a wireless power transmitting circuit spaced apart from the wireless power receiving circuit.

In one preferred and non-limiting embodiment or aspect, the power supply assembly further comprises the wireless power transmitting circuit, wherein the wireless power transmitting circuit is positioned in a wall, and wherein the wireless power receiving circuit is spaced apart from the wall.

In one preferred and non-limiting embodiment or aspect, the wireless power transmitting circuit is coupled to a mains electricity power supply.

In one preferred and non-limiting embodiment or aspect, the plumbing fixture includes a trigger device in communication with the control circuit, and wherein the control circuit is configured to control the operation of the plumbing fixture based on a state of the trigger device.

In one preferred and non-limiting embodiment or aspect, the trigger device comprises one of a button, a switch, a dial, an infrared (IR) sensor, and a proximity sensor.

In one preferred and non-limiting embodiment or aspect, the plumbing fixture comprises at least one of a toilet fixture, a shower fixture, a faucet fixture, and a drinking fountain fixture.

In one preferred and non-limiting embodiment or aspect, the plumbing fixture comprises a flushing system including a flush valve, wherein the flush valve includes a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, and wherein the control circuit is configured to control the main valve element to transition between the closed position and the open position.

According to one preferred and non-limiting embodiment or aspect, provided is a method for supplying power to a plumbing fixture, comprising: controlling, by a control circuit, operation of the plumbing fixture; wirelessly receiving, by a wireless power receiving circuit, energy, wherein the wireless power receiving circuit is coupled to the control circuit; and providing, by the wireless power receiving circuit, the energy to the control circuit.

In one preferred and non-limiting embodiment or aspect, the method further comprises driving, by the control circuit, a solenoid to control the operation of the plumbing fixture.

In one preferred and non-limiting embodiment or aspect, the wireless power receiving circuit includes a battery configured to store the energy, the method further comprising: charging, by the wireless power receiving circuit, the battery with the energy; and receiving, by the control circuit, a supply of power from the battery.

In one preferred and non-limiting embodiment or aspect, the method further comprises wirelessly transmitting, by a wireless power transmitting circuit, the energy to the wireless power receiving circuit.

In one preferred and non-limiting embodiment or aspect, the wireless power transmitting circuit is spaced apart from the wireless power receiving circuit.

In one preferred and non-limiting embodiment or aspect, the wireless power transmitting circuit is coupled to a mains electricity power supply.

In one preferred and non-limiting embodiment or aspect, the plumbing fixture includes a trigger device in communication with the control circuit, the method further comprising controlling, by the control circuit, the operation of the plumbing fixture based on a state of the trigger device.

In one preferred and non-limiting embodiment or aspect, the trigger device comprises one of a button, a switch, a dial, an infrared (IR) sensor, and a proximity sensor.

In one preferred and non-limiting embodiment or aspect, the plumbing fixture comprises at least one of a toilet fixture, a shower fixture, a faucet fixture, and a drinking fountain fixture.

In one preferred and non-limiting embodiment or aspect, the plumbing fixture comprises a flushing system including a flush valve, wherein the flush valve includes a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, the method further comprising controlling, by the control circuit, the main valve element to transition between the closed position and the open position.

According to one preferred and non-limiting embodiment or aspect, provided is a flush valve, comprising: a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication; a control circuit configured to control the main valve element to transition between the closed position and the open position; and a wireless power receiving circuit coupled to the control circuit, the wireless power receiving circuit configured to receive energy wirelessly from a wireless power transmitting circuit.

According to one preferred and non-limiting embodiment or aspect, provided is a wirelessly powered flushing system, comprising: a flush valve including: a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication; a control circuit configured to control the main valve element to transition between the closed position and the open position; a wireless power receiving circuit coupled to the control circuit, the wireless power receiving circuit configured to receive energy wirelessly; and a wireless power transmitting circuit configured to wirelessly transmit the energy to the wireless power receiving circuit.

According to one preferred and non-limiting embodiment or aspect, provided is a method for providing power to a flushing system, the flushing system including a flush valve including a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, and a control circuit configured to control the main valve element to transition between the closed position and the open position, the method comprising: wirelessly transmitting, by a wireless power transmitting circuit, energy to a wireless power receiving circuit coupled to the control circuit, wirelessly receiving, by the wireless power receiving circuit, the energy from the wireless power transmitting circuit; providing, by the wireless power receiving circuit, the energy to the control circuit; and controlling, by the control circuit, the main valve element to transition between the closed position and the open position.

Other preferred and non-limiting embodiments or aspects of the present invention will be set forth in the following numbered clauses:

Clause 1. A power supply assembly for a plumbing fixture, comprising: a control circuit configured to control operation of the plumbing fixture; and a wireless power receiving circuit coupled to the control circuit, the wireless power receiving circuit configured to wirelessly receive energy and provide the energy to the control circuit.

Clause 2. The power supply assembly of clause 1, further comprising a housing configured for mounting on the plumbing fixture, the housing including the wireless power receiving circuit coupled to the control circuit.

Clause 3. The power supply assembly of clause 1 or 2, wherein the control circuit is configured to drive a solenoid to control the operation of the plumbing fixture.

Clause 4. The power supply assembly of any of clauses 1-3, wherein the wireless power receiving circuit includes a battery configured to store the energy, wherein the wireless power receiving circuit is configured to charge the battery with the energy, and wherein the control circuit is configured to receive a supply of power from the battery.

Clause 5. The power supply assembly of any of clauses 1-4, wherein the wireless power receiving circuit is configured to receive the energy wirelessly from a wireless power transmitting circuit spaced apart from the wireless power receiving circuit.

Clause 6. The power supply assembly of any of clauses 1-5, further comprising the wireless power transmitting circuit, wherein the wireless power transmitting circuit is positioned in a wall, and wherein the wireless power receiving circuit is spaced apart from the wall.

Clause 7. The power supply assembly of any of clauses 1-6, wherein the wireless power transmitting circuit is coupled to a mains electricity power supply.

Clause 8. The power supply assembly of any of clauses 1-7, wherein the plumbing fixture includes a trigger device in communication with the control circuit, and wherein the control circuit is configured to control the operation of the plumbing fixture based on a state of the trigger device.

Clause 9. The power supply assembly of any of clauses 1-8, wherein the trigger device comprises one of a button, a switch, a dial, an infrared (IR) sensor, and a proximity sensor.

Clause 10. The power supply assembly of any of clauses 1-9, wherein the plumbing fixture comprises at least one of a toilet fixture, a shower fixture, a faucet fixture, and a drinking fountain fixture.

Clause 11. The power supply assembly of any of clauses 1-10, wherein the plumbing fixture comprises a flushing system including a flush valve, wherein the flush valve includes a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, and wherein the control circuit is configured to control the main valve element to transition between the closed position and the open position.

Clause 12. A method for supplying power to a plumbing fixture, comprising: controlling, by a control circuit, operation of the plumbing fixture; wirelessly receiving, by a wireless power receiving circuit, energy, wherein the wireless power receiving circuit is coupled to the control circuit; and providing, by the wireless power receiving circuit, the energy to the control circuit.

Clause 13. The method of clause 12, further comprising driving, by the control circuit, a solenoid to control the operation of the plumbing fixture.

Clause 14. The method of clause 12 or 13, wherein the wireless power receiving circuit includes a battery configured to store the energy, the method further comprising: charging, by the wireless power receiving circuit, the battery with the energy; and receiving, by the control circuit, a supply of power from the battery.

Clause 15. The method of any of clauses 12-14, further comprising wirelessly transmitting, by a wireless power transmitting circuit, the energy to the wireless power receiving circuit.

Clause 16. The method of any of clauses 12-15, wherein the wireless power transmitting circuit is spaced apart from the wireless power receiving circuit.

Clause 17. The method of any of clauses 12-16, wherein the wireless power transmitting circuit is coupled to a mains electricity power supply.

Clause 18. The method of any of clauses 12-17, wherein the plumbing fixture includes a trigger device in communication with the control circuit, the method further comprising controlling, by the control circuit, the operation of the plumbing fixture based on a state of the trigger device.

Clause 19. The method of any of clauses 12-18, wherein the trigger device comprises one of a button, a switch, a dial, an infrared (IR) sensor, and a proximity sensor.

Clause 20. The method of any of clauses 12-19, wherein the plumbing fixture comprises at least one of a toilet fixture, a shower fixture, a faucet fixture, and a drinking fountain fixture.

Clause 21. The method of any of clauses 12-20, wherein the plumbing fixture comprises a flushing system including a flush valve, wherein the flush valve includes a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, the method further comprising controlling, by the control circuit, the main valve element to transition between the closed position and the open position.

Clause 22. A flush valve, comprising: a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication; a control circuit configured to control the main valve element to transition between the closed position and the open position; and a wireless power receiving circuit coupled to the control circuit, the wireless power receiving circuit configured to receive energy wirelessly from a wireless power transmitting circuit.

Clause 23. A wirelessly powered flushing system, comprising: a flush valve including: a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication; a control circuit configured to control the main valve element to transition between the closed position and the open position; a wireless power receiving circuit coupled to the control circuit, the wireless power receiving circuit configured to receive energy wirelessly; and a wireless power transmitting circuit configured to wirelessly transmit the energy to the wireless power receiving circuit.

Clause 24. A method for providing power to a flushing system, the flushing system including a flush valve including a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, and a control circuit configured to control the main valve element to transition between the closed position and the open position, the method comprising: wirelessly transmitting, by a wireless power transmitting circuit, energy to a wireless power receiving circuit coupled to the control circuit, wirelessly receiving, by the wireless power receiving circuit, the energy from the wireless power transmitting circuit; providing, by the wireless power receiving circuit, the energy to the control circuit; and controlling, by the control circuit, the main valve element to transition between the closed position and the open position.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

Additional advantages and details of the invention are explained in greater detail below with reference to the exemplary embodiments that are illustrated in the accompanying schematic figures, in which.

DESCRIPTION OF THE PREFERRED EMBODIMENTS

Figure 1:
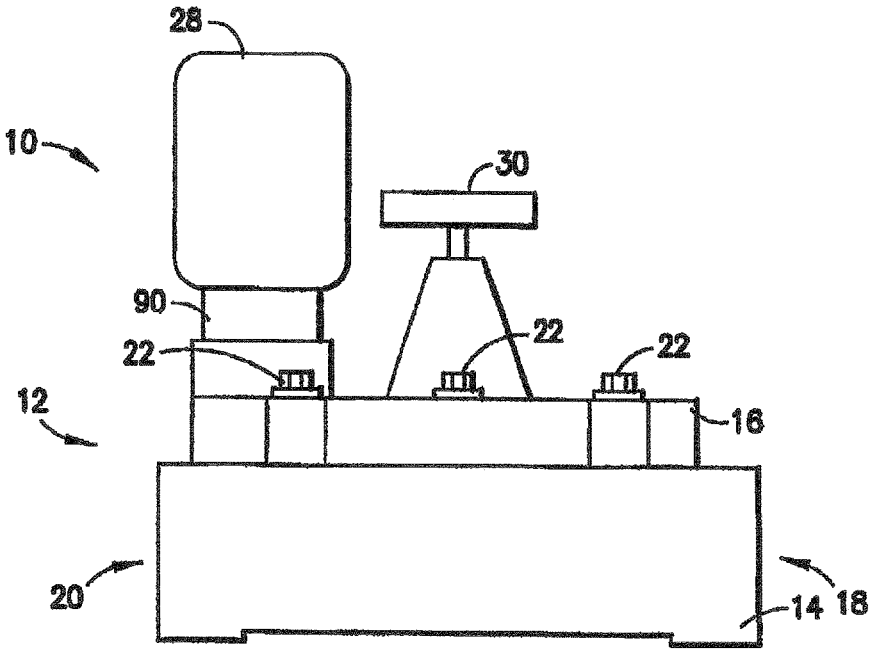
FIG. 1 is a side view of a valve for a plumbing fixture according to the principles of the present invention.
Figure 2:
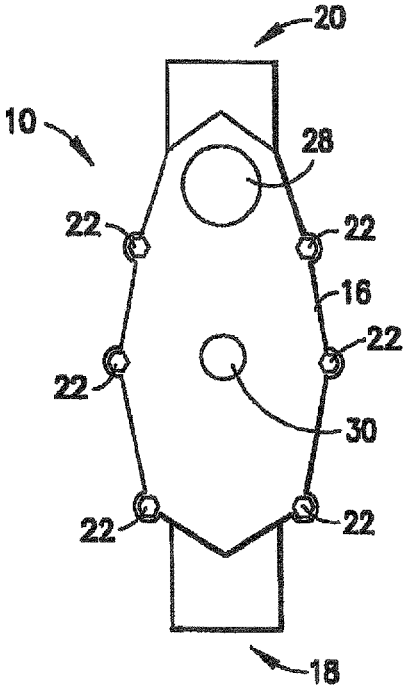
FIG. 2 is a top view of the valve of FIG. 1.
Figure 3:
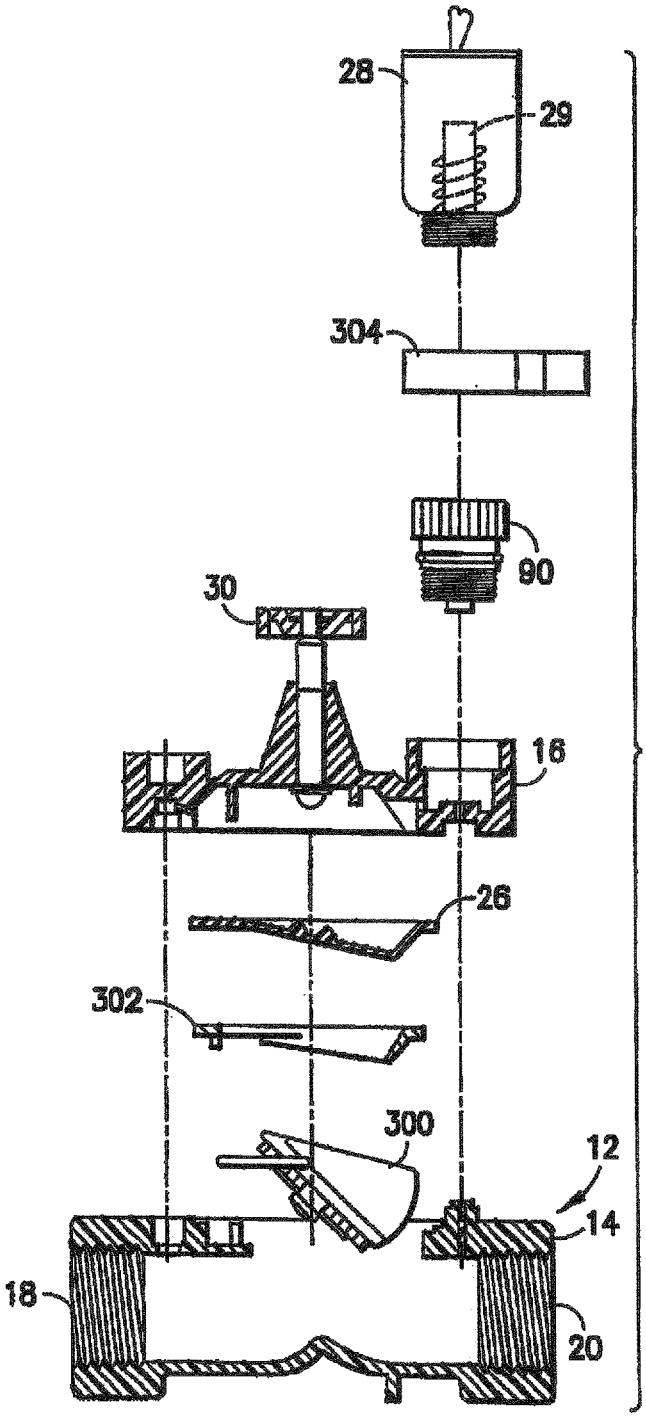
FIG. 3 is an exploded view of the valve of FIG. 1.

As used herein, spatial or directional terms, such as "up", "down", "above", "below", "top", "bottom", and the like, relate to the invention as it is shown in the drawing figures. However, it is to be understood that the invention can assume various alternative orientations and, accordingly, such terms are not to be considered as limiting. Further, all numbers expressing dimensions, physical characteristics, processing parameters, quantities of ingredients, reaction conditions, and the like used in the specification and claims are to be understood as being modified in all instances by the term "about". Accordingly, unless indicated to the contrary, the numerical values set forth in the following specification and claims are approximations that can vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.1, 3.5 to 7.8, 5.5 to 10, etc. All references referred to herein, such as but not limited to issued patents and published applications, are to be understood to be incorporated by reference in their entirety. The term "mechanical relief" refers to a relief device or system that does not require electricity or electrical power to function in a pressure relieving capacity. The term "electronic relief" refers to a relief device or system that utilizes electricity or electrical power to function in a pressure relieving capacity.

As used herein, the terms "communication" and "communicate" refer to the receipt or transfer of one or more signals, messages, commands, or other type of data. For one unit or component to be in communication with another unit or component means that the one unit or component is able to directly or indirectly receive data from and/or transmit data to the other unit or component. This can refer to a direct or indirect connection that may be wired and/or wireless in nature. Additionally, two units or components may be in communication with each other even though the data transmitted may be modified, processed, and/or routed between the first and second unit or component. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible.

It will be appreciated that various types of plumbing fixtures may be used in connection with the present invention. The term "plumbing fixture" may refer to, for example, one or more toilet fixtures, shower fixtures, faucet fixtures, and drinking fountain fixtures, and/or other like devices and/or components thereof. In some non-limiting embodiments, the plumbing fixtures may include flush valves. U.S. patent application Ser. No. 14/301,447, entitled "Method of Monitoring Wear in a Diaphragm Valve Using Pressure Detection", the disclosure of which is hereby incorporated by reference in its entirety, describes valves that could be used in connection with the present invention, although it will be appreciated that various other types of valves, plumbing equipment, and arrangements may be used in connection with embodiments of the present invention.

FIGS. 1-5 show an example valve 10, which may be included in a plumbing fixture according to a preferred and non-limiting embodiment or aspect of present invention. The basic components of the valve 10 will first be described in order to clarify the subsequent discussion of the invention.

Figure 4:
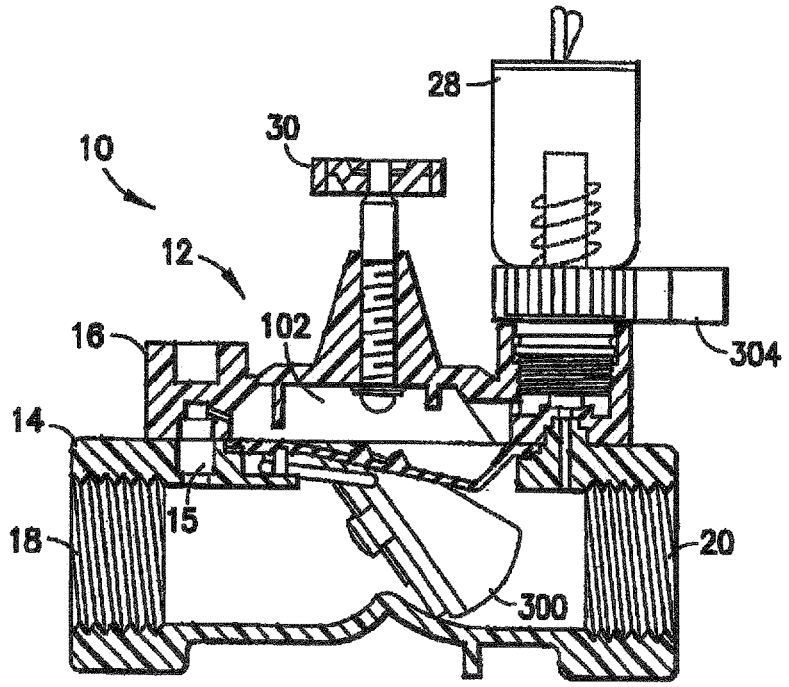
FIG. 4 is a side, sectional view of the valve of FIG. 1 in a closed configuration.
Figure 5:
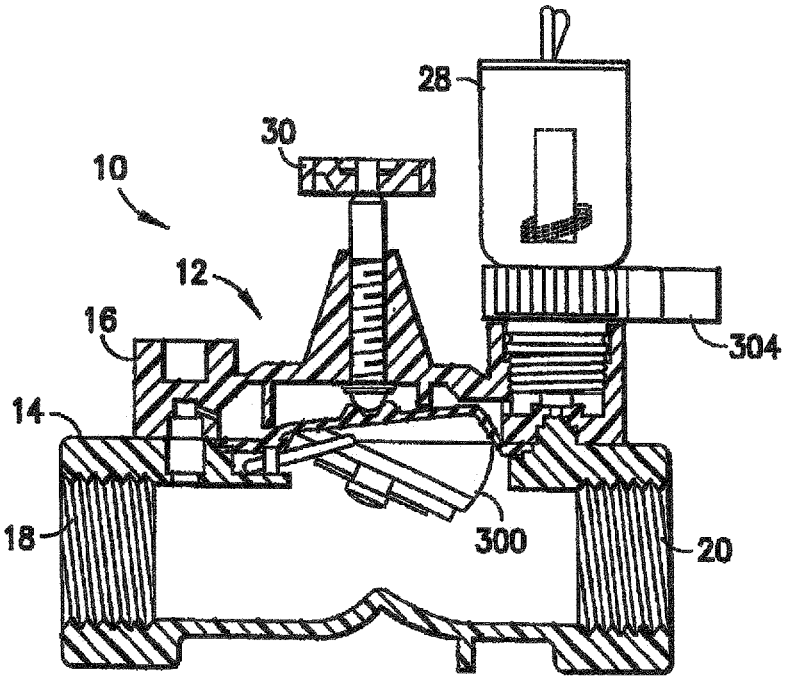
FIG. 5 is a side, sectional view of the valve of FIG. 1 in an open configuration.

In one preferred and non-limiting embodiment, the valve 10 can be a diaphragm-type valve having a valve housing 12 formed by a valve body 14 and a cover 16. The valve body 14 and/or cover 16 can be of any desired material, for example, metal or plastic. In one non-limiting embodiment, the valve body 14 and cover 16 can both be made of plastic or one can be plastic and the other metal. The valve body 14 has a flow passage extending therethrough with an inlet end 18 and an outlet end 20. The cover 16 is connected to the valve body 14 by a plurality of bolts 22, such as aluminum or stainless steel bolts, threadably engagable with insert nuts 24 in the valve body 14. The insert nuts 24 can also be metal, such as brass or, more preferably, steel. A diaphragm 26 of suitable material, such as rubber or plastic, is sandwiched between the valve body 14 and the cover 16 to form a seal between the two chambers of the valve 10. A valve element 300 is positioned in the flow passage and the upper side of the valve element 300 engages the central region of the diaphragm 26 when the valve 10 is assembled. In one embodiment, the valve element 300 is a conventional swing check valve. The valve 10 further includes a solenoid 28 threadably attached to the cover 16 and operationally connected with a vent system to control water pressure in a control chamber formed above the diaphragm 26, as is typical in known diaphragm valves. In one non-limiting embodiment the vent system includes a passage, such as a crescent-shaped vent passage, in flow communication on one end with the control chamber and on the other end with a vent chamber. Flow through a vent outlet for the vent chamber is controlled by a plunger 29 associated with the solenoid 28, which can be moved to open or close the vent outlet. The valve 10 also includes a rotatable stop 30 that can be used to adjust or control the maximum opening position of the valve element. The valve 10 also includes a swing check retaining ring 302 to retain the valve element 300 in the valve body 14. In the illustrated embodiment, the solenoid 28 is connected to the valve cover 16 by a bleed plug or fitting 90. A manual override lever 304 can be operatively connected to the solenoid 28. FIG. 4 shows the valve 10 in a closed configuration in which the valve element 300 blocks the flow passage, preventing fluid flow through the valve 10. FIG. 5 shows the valve 10 in an open configuration in which fluid can flow from the inlet end 18, through the flow passage, and out the outlet end 20.

The above-described diaphragm valve basic components and their operation will be well understood by one of ordinary skill in the diaphragm valve art and, hence, will not be described in greater detail. Examples of known diaphragm valves and their operation are described, for example, in U.S. Pat. Nos. 4,336,918; 4,301,992; 4,893,645; 4,797,820; 4,477,051; 4,787,413; 5,853,026; and 6,557,580. It will be further appreciated that operation of a plumbing fixture according to preferred and non-limiting embodiments or aspects need to be limited to operation of a diaphragm valve and that various other types of valves, plumbing equipment, and arrangements may be used in connection with embodiments of the present invention. For example, U.S. Pat. No. 7,322,054, entitled "Automatic Toilet Flushing System and Method", the disclosure of which is hereby incorporated by reference in its entirety, describes a flush valve that provides fluid communication between a toilet bowl and a holding tank. In other preferred and non-limiting embodiments, operation of the plumbing fixture may include the control of the flow of water from a showerhead, a faucet, and a drinking fountain, and/or other like devices and/or components thereof.

Figure 6:
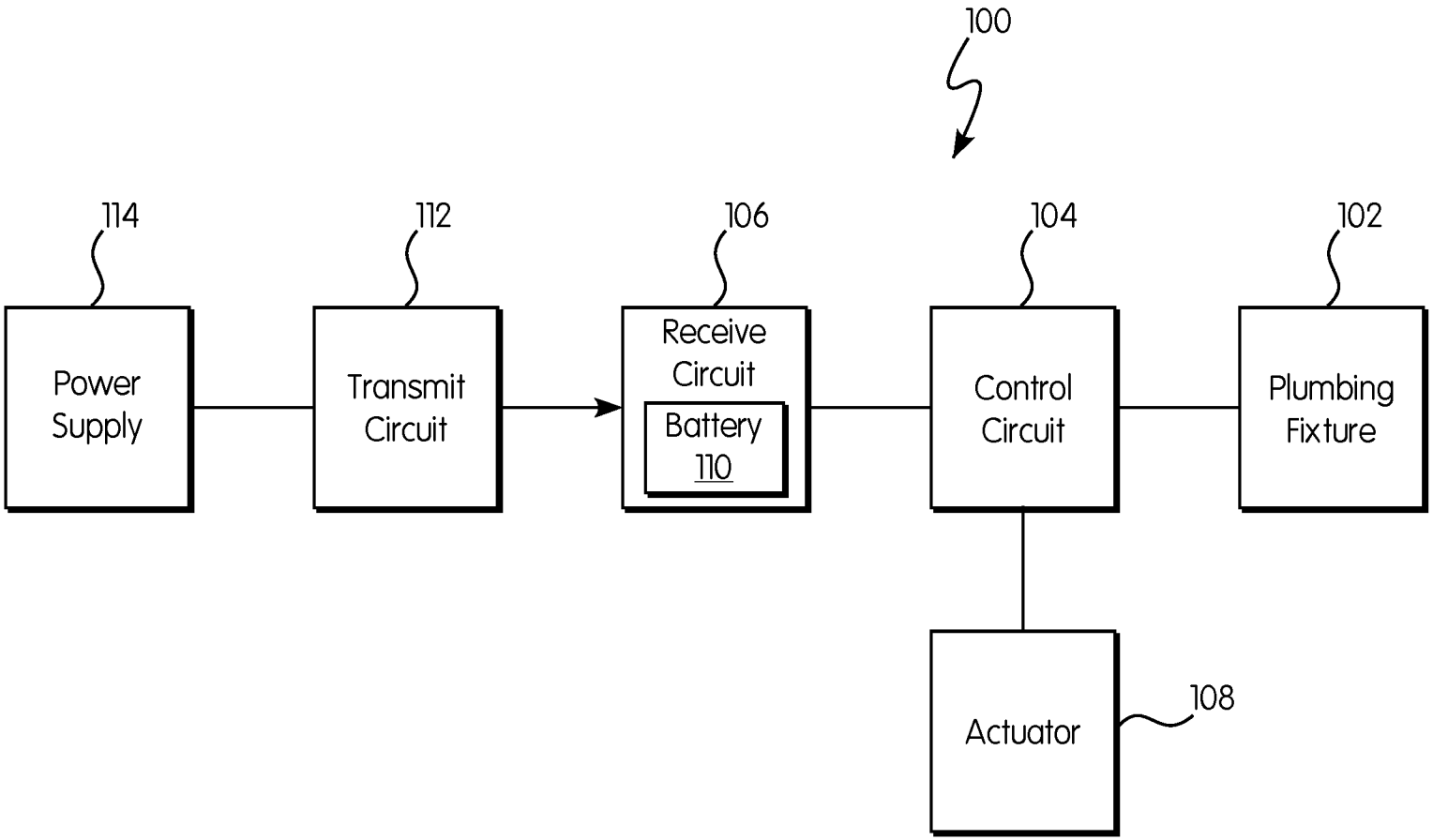
FIG. 6 is a schematic diagram of a power supply assembly for a plumbing fixture according to the principles of the present invention.

Referring now to FIG. 6, a power supply assembly 100 for a plumbing fixture 102 comprises a control circuit 104 configured to control operation of the plumbing fixture 102, a wireless power receiving circuit 106 coupled to the control circuit 104, and/or a wireless power transmitting circuit 112 configured to wirelessly transmit energy to the wireless power receiving circuit 106. The control circuit 104 can include, for example, a conventional 410 or 810 control board and/or a microprocessor, as well as various circuitry for driving or powering the solenoid 28 or other means for controlling operation of the plumbing fixture 102. The control circuit 104 is connected to the wireless power receiving circuit 106, which acts as an electrical power source to provide electrical power to the control circuit 104 to power the control circuit 104 and to provide a supply of power for the control circuit 104 to drive the solenoid 28 or other control means for controlling operation of the plumbing fixture 102, such as, by one or more wires or cables.

In some implementations, an actuator or trigger device 108, such as, a button, a switch, a dial, an infrared (IR) sensor, or a proximity sensor, is in communication with the control circuit 104, such as, by a wire or cable, and the control circuit 104 is configured to control the operation of the plumbing fixture 102 based on a state of the trigger device 108. For example, when the valve 10 or other control means is to be opened to permit flushing or another operation of the plumbing fixture 102, the trigger device 108 is actuated, such as, by pressing a button. Upon receiving the actuation signal, the control circuit 104 sends a signal via the cable to the solenoid 28 to energize the coils, which results in opening of the main valve element 300 of the valve 10. In another example, the trigger device 108 is operatively connected to the control circuit 104 for providing a detection signal to the control circuit 104 indicative of the presence of a person in an area in front of the plumbing fixture 102. The control circuit 104 receives the detection signal from the trigger device 108, which may be a conventional optical or acoustical sensing and control device known in the field of automatic toilet flushing systems. The control circuit 104 is configured to control the operation of the plumbing fixture 102 based on a state of the trigger device 108, e.g., based on the detection signal from the trigger device 108, to drive the solenoid 28 to open the main valve element 300 of the valve 10 of the plumbing fixture 102.

Various types of wireless charging technology may be used to transfer the energy from the wireless power transmitting circuit 112 to the wireless power receiving circuit 106. For example, the wireless power transmitting circuit 112 and the wireless power receiving circuit 106 may be configured to use electromagnetic induction type power transmission using coils, resonance based power transmission, Radio Frequency (RF) or microwave radiation type power transmission converting electric energy into a microwave to transfer the power, and the like. For example, electromagnetic induction type power transmission may be used for shorter transfer distances, and RF or microwave radiation type power transmission may be used to wirelessly transmit power over greater distances.

Electromagnetic induction type power transmission transmits power between a primary coil and a secondary coil using the property that a current is induced through the movement of a magnet against a coil to generate the electricity. The wireless power transmitting circuit 112 can thus generate a magnetic field, and the wireless power receiving circuit 106 can serve as a magnet to produce energy. This phenomenon is called the magnetic induction phenomenon, and a power transmission method using this phenomenon has excellent energy transmission efficiency.

Resonance type power transmission uses the resonance characteristics of an electromagnetic wave, and can be used for charging from a distance of several meters. An electromagnetic wave can carry the electric energy resonate rather than sound. Since this resonating electromagnetic wave is directly transferred only where a device having the resonance frequency exists and a portion that is not in use is reabsorbed into the electromagnetic field instead of spreading in the air, it is expected that the resonating electromagnetic wave will exert no influence on surrounding machines or human bodies, unlike other electromagnetic waves.

RF/microwave radiation type is a newer type of power transmission that transfers energy through a conversion of the power energy into a microwave that is favorable to the wireless transmission. The power transmission is to transmit the electric energy rather than a signal that is used in a wireless communications, such as, a radio receiver, a wireless phone, or the like. That is, whereas typical communication is to transmit a signal that is carried on a carrier signal, the wireless power transmission is to transmit only the carrier.

Accordingly, the wireless power receiving circuit 106 and the wireless power transmitting circuit 112 may be configured to use any known type of wireless power transmission; however, in the interest of clarity and brevity, disclosed embodiments are discussed below mainly with respect to a power supply assembly including the wireless power receiving circuit 106 and the wireless power transmitting circuit 112 configured for electromagnetic induction type power transmission.

The wireless power transmitting circuit 112 may include one or more magnetic induction coil(s) configured to wirelessly transmit energy from a power supply 114 to one or more receiving coil(s) of the wireless power receiving circuit 106. The wireless power receiving circuit 106 may further include a means for changing the received AC voltage to DC voltage, such as rectification and smoothing with one or more rectifiers or, e.g., a bridge or synchronous rectifier and one or more capacitors. For example, the control circuit 104 may require DC voltage to operate and/or drive the solenoid 28. The wireless power receiving circuit 106 can be a flat or curved surface or part that can receive the energy wirelessly, and may be constructed of flexible materials and/or coils or plastic electronics, to enable mechanical flexibility and bending or folding to save space or for conformity to non-flat surfaces. The wireless power receiving circuit 106 may include a regulator such as linear, buck, boost or buck boost regulator and/or switch for the output power. Additionally, the wireless power receiving circuit 106 can include communication circuitry to communicate data with the wireless power transmitting circuit 112, such as, via Near Field Communication (NFC), Bluetooth, WiFi, RFID or other communication and/or verification technology. The electronics of the wireless power receiving circuit 106 can comprise discrete components or microcontrollers that when used together provide the wireless receiver functionality, or comprise an MCM or Application Specific Integrate Circuit (ASIC) chip or chipset that is specifically designed to function as the whole or a substantial part of the electronics for the wireless power receiving circuit 106.

The wireless power transmitting circuit 112 can be a flat or curved surface or part that can provide energy wirelessly to the wireless power receiving circuit 106. The wireless power transmitting circuit 112 can be constructed of flexible materials and/or coils, or plastic electronics, to enable mechanical flexibility and bending or folding to save space or for conformity to non-flat surfaces. The wireless power transmitting circuit 112 can be directly powered by a mains electrical power source, AC power input, DC power, or other power source such as an automobile, bus, motorcycle, truck or other vehicle or train, airplane or boat or ship or other transport system or vehicle power outlet, or through being built into and powered by such transport vehicles or systems, primary (non-rechargeable) or rechargeable battery, solar cell, fuel cell, mechanical (e.g., hand crank, wind, water source), nuclear source or other or another wireless charger or power supply or a combination thereof. The wireless power transmitting circuit 112 can be integrated and/or powered by a part such as a rechargeable battery which is itself recharged by another source such as an AC or DC power source, automobile, bus, vehicle, boat or ship or airplane power outlet or vehicle, boat, train or ship or airplane or other transport system or vehicle itself, solar cell, fuel cell, or mechanical (e.g., hand crank, wind, water) or nuclear or other source, or a combination thereof. In instances where the wireless charger is powered by a rechargeable source, such as, a battery, the battery can also be itself inductively charged by another wireless charger. The wireless power transmitter 112 may generate a repetitive power signal pattern (such as a sinusoid or square wave from 10's of Hz to several MHz or even higher, but typically in the 100 kHz to several MHz range) with a coil drive circuit and a coil or antenna for transmission of the energy to the wireless power receiving circuit 106.

In one example, the wireless power receiving circuit 106 may include a battery 110 configured to store the energy wirelessly received from the wireless power transmitting circuit 112. For example, the wireless power receiving circuit 106 may be configured to charge the battery 110 with the energy wirelessly received from the wireless power transmitting circuit 112, and the control circuit 104 can be configured to receive the supply of power from the battery 110. In some implementations, depending on the degree of charge status of the battery 110 or its presence and the system design, the wireless power receiving circuit 106 can use the wirelessly received energy to provide power to the control circuit 104, charge the battery 110, or a combination of the above.

Figure 7:
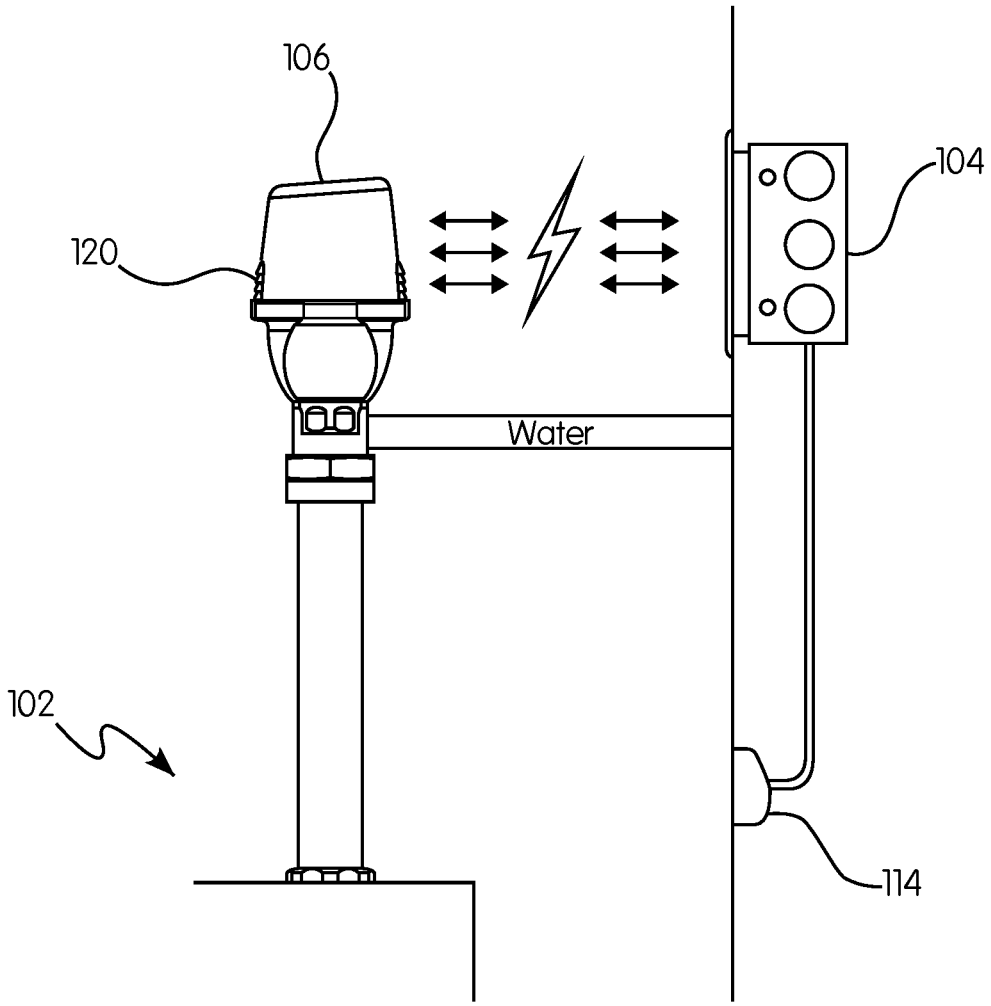
FIG. 7 is a side view of a power supply assembly for a plumbing fixture according to the principles of the present invention.

Referring now to FIG. 7, a housing 120 including the wireless power receiving circuit 106 coupled to the control circuit 104 may be mounted to the plumbing fixture 102. For example, the housing 120 may be mounted to a valve 110 of the plumbing fixture 102. In one implementation, the plumbing fixture 102 can be a permanently installed fixture, such as, a toilet or a urinal permanently secured to the floor or a wall 122. In an example, as shown in FIG. 7, the wireless power transmitting circuit 112 is positioned or located at or in the wall 122, and the wireless power receiving circuit 106 is spaced apart from the wall 122. The wireless power receiving circuit 106 may be aligned with the wireless power transmitting circuit 112 across the distance therebetween. The wireless power transmitting circuit 112 may be coupled to a mains electricity power supply 114 within the wall 122. In some implementations, the wireless power transmitting circuit 112 may be mounted flush with the wall 122. Accordingly, a through wall connection for providing power to the control circuit 104 to control operation of the plumbing fixture 102 is not needed, because the wireless power receiving circuit 106 and the wireless power transmitting circuit 112 may be spaced apart from each other such that the energy is transferred across the distance therebetween. The battery 110 may be located in the housing 120 such that it can be easily replaced without requiring a disassembly of a flush valve 10 of the plumbing fixture 102. For example, the battery 110 can be accessible through a removable panel in the housing 120 that can be removed without requiring the housing 120 to be removed from its mounted position on the valve 10.

Figure 8:
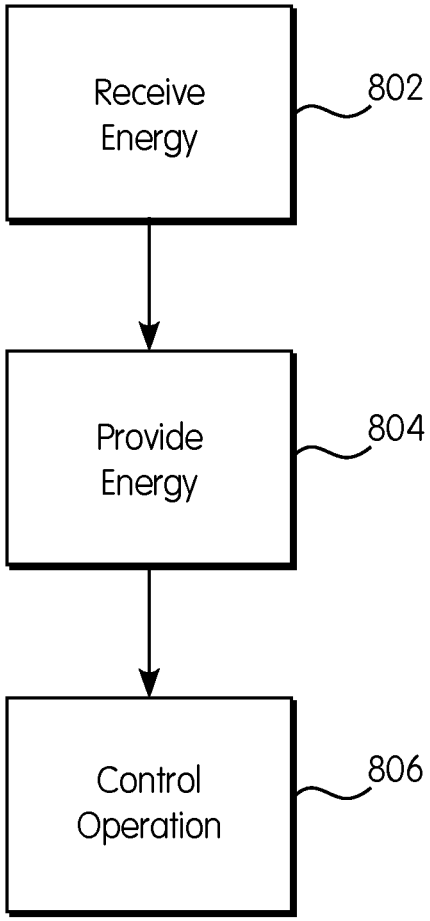
FIG. 8 is a flow chart of a method for supplying power to a plumbing fixture according to the principles of the present invention.

Referring now to FIG. 8, a method for supplying power to a plumbing fixture according to principles of the present invention may include wirelessly receiving, by the wireless power receiving circuit 106, energy, from the wireless power transmitting circuit 112 in stage 802. The wireless power receiving circuit 106 can provide the energy to the control circuit in stage 804. For example, the wireless power receiving circuit 106 can charge the battery 110 with the energy, and the control circuit 104 can receive a supply of power from the battery 110. In stage 806, the control circuit 104 can control operation of the plumbing fixture 102. For example, the control circuit 104 can control the main valve element 300 of a valve 10 of the plumbing fixture 102 to transition between a closed position and an open position based on a state of a trigger device 108.

It will be readily appreciated by those skilled in the art that modifications may be made to the invention without departing from the concepts disclosed in the foregoing description. For example, various components of the mechanical and electronic relief devices described above can be used together in the same valve. Accordingly, the particular embodiments described in detail herein are illustrative only and are not limiting to the scope of the invention, which is to be given the full breadth of the appended claims and any and all equivalents thereof.

The invention claimed is:

1. A power supply assembly for a plumbing fixture, comprising:

a control circuit configured to control operation of the plumbing fixture;

a wireless power receiving circuit coupled to the control circuit, the wireless power receiving circuit configured to wirelessly receive energy and provide the energy to the control circuit; and a housing mounted on the plumbing fixture, wherein the housing includes the wireless power receiving circuit coupled to the control circuit.

2. The power supply assembly of claim 1, wherein the control circuit is configured to drive a solenoid to control the operation of the plumbing fixture.

3. The power supply assembly of claim 1, wherein the wireless power receiving circuit includes a battery within the housing configured to store the energy, wherein the wireless power receiving circuit is configured to charge the battery with the energy, wherein the control circuit is configured to receive a supply of power from the battery, wherein the battery is accessible through a removable panel in the housing, and wherein the removable panel is removable without the housing being removed from its mounted position on the plumbing fixture.

4. The power supply assembly of claim 1, wherein the wireless power receiving circuit is configured to receive the energy wirelessly from a wireless power transmitting circuit spaced apart from the wireless power receiving circuit, and wherein the wireless power receiving circuit includes communication circuitry that communicates data with the wireless power transmitting circuit.

5. The power supply assembly of claim 4, further comprising the wireless power transmitting circuit, wherein the wireless power transmitting circuit is positioned in a wall and mounted flush with the wall, and wherein the wireless power receiving circuit is spaced apart from the wall.

6. The power supply assembly of claim 5, wherein the wireless power transmitting circuit is coupled to a mains electricity power supply.

7. The power supply assembly of claim 1, wherein the plumbing fixture includes a trigger device in communication with the control circuit, and wherein the control circuit is configured to control the operation of the plumbing fixture based on a state of the trigger device.

8. The power supply assembly of claim 7, wherein the trigger device comprises one of a button, a switch, a dial, an infrared (IR) sensor, and a proximity sensor.

9. The power supply assembly of claim 1, wherein the plumbing fixture comprises at least one of a toilet fixture, a shower fixture, a faucet fixture, and a drinking fountain fixture.

10. The power supply assembly of claim 1, wherein the plumbing fixture comprises a flushing system including a flush valve, wherein the flush valve includes a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, and wherein the control circuit is configured to control the main valve element to transition between the closed position and the open position.

11. A method for supplying power to a plumbing fixture, comprising:

controlling, by a control circuit, operation of the plumbing fixture;

wirelessly receiving, by a wireless power receiving circuit, energy from a wireless power transmitting circuit, wherein the wireless power receiving circuit is coupled to the control circuit;

providing, by the wireless power receiving circuit, the energy to the control circuit; and communicating, by the wireless power receiving circuit, data to the wireless power transmitting circuit.

12. The method of claim 11, further comprising driving, by the control circuit, a solenoid to control the operation of the plumbing fixture.

13. The method of claim 11, wherein the wireless power receiving circuit includes a battery configured to store the energy, the method further comprising:

depending on a degree of a charge status of the battery:

(i) providing, by the wireless power receiving circuit, power to the control circuit with the energy;

(ii) charging, by the wireless power receiving circuit, the battery with the energy; or performing, by the wireless power receiving circuit, a combination of (i) and (ii).

14. The method of claim 11, further comprising wirelessly transmitting, by the wireless power transmitting circuit, the energy to the wireless power receiving circuit.

15. The method of claim 14, wherein the wireless power transmitting circuit is spaced apart from the wireless power receiving circuit, wherein the wireless power transmitting circuit is positioned in a wall and mounted flush with the wall, and wherein the wireless power receiving circuit is spaced apart from the wall.

16. The method of claim 14, wherein the wireless power transmitting circuit is coupled to a mains electricity power supply.

17. The method of claim 11, wherein the plumbing fixture includes a trigger device in communication with the control circuit, the method further comprising controlling, by the control circuit, the operation of the plumbing fixture based on a state of the trigger device.

18. The method of claim 17, wherein the trigger device comprises one of a button, a switch, a dial, an infrared (IR) sensor, and a proximity sensor.

19. The method of claim 11, wherein the plumbing fixture comprises at least one of a toilet fixture, a shower fixture, a faucet fixture, and a drinking fountain fixture.

20. The method of claim 11, wherein the plumbing fixture comprises a flushing system including a flush valve, wherein the flush valve includes a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, the method further comprising controlling, by the control circuit, the main valve element to transition between the closed position and the open position.

21. A flush valve, comprising:

a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication;

a control circuit configured to control the main valve element to transition between the closed position and the open position; and a wireless power receiving circuit coupled to the control circuit, the wireless power receiving circuit configured to receive energy wirelessly from a wireless power transmitting circuit, wherein a housing is mounted on the flush valve, wherein the housing includes the wireless power receiving circuit coupled to the control circuit.

22. A wirelessly powered flushing system, comprising:

a flush valve including:

a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication;

a control circuit configured to control the main valve element to transition between the closed position and the open position;

a wireless power receiving circuit coupled to the control circuit, the wireless power receiving circuit configured to receive energy wirelessly;

a wireless power transmitting circuit configured to wirelessly transmit the energy to the wireless power receiving circuit; and a housing mounted on the flush valve, wherein the housing includes the wireless power receiving circuit coupled to the control circuit.

23. A method for providing power to a flushing system, the flushing system including a flush valve including a valve body comprising a fluid inlet and a fluid outlet, and a main valve element configured to transition between a closed position, in which the fluid inlet and the fluid outlet are in fluid isolation, and an open position, in which the fluid inlet and the fluid outlet are in fluid communication, and a control circuit configured to control the main valve element to transition between the closed position and the open position, the method comprising:

wirelessly transmitting, by a wireless power transmitting circuit, energy to a wireless power receiving circuit coupled to the control circuit, wirelessly receiving, by the wireless power receiving circuit, the energy from the wireless power transmitting circuit;

providing, by the wireless power receiving circuit, the energy to the control circuit;

controlling, by the control circuit, the main valve element to transition between the closed position and the open position; and communicating, by the wireless power receiving circuit, data to the wireless power transmitting circuit.

* * * * *